US006012740A

United States Patent [19]

Lupi

[11] Patent Number: 6,012,740

[45] Date of Patent: Jan. 11, 2000

[54] COMBINATION SAMPLE MEDICATION PAYMENT CHECK AND MEDICATION PRESCRIPTION DEVICE

[76] Inventor: L. Anthony Lupi, 3004 Proctor Rd., Sarasota, Fla. 34231

[21] Appl. No.: 09/128,171

[22] Filed: Aug. 3, 1998

[51] Int. Cl.[7] ..... B42F 21/00; B42D 15/00

[52] U.S. Cl. ..... 283/58; 283/42; 283/56; 283/67; 283/81; 283/48.1; 283/58

[58] Field of Search ..... 283/900, 57, 58, 283/51, 61, 62

[56] References Cited

U.S. PATENT DOCUMENTS

| | | | |
|---|---|---|---|
| 364,623 | 6/1887 | Beidler . | |
| 1,492,101 | 4/1924 | Mordecia . | |
| 3,111,220 | 11/1963 | Bostrom . | |
| 3,327,843 | 6/1967 | O'Meara . | |
| 3,381,808 | 5/1968 | McGraw, II . | |
| 4,807,909 | 2/1989 | Lapsker | 283/42 |
| 4,971,362 | 11/1990 | Lapsker | 283/58 |
| 5,178,417 | 1/1993 | Eshoo | 283/81 |
| 5,181,743 | 1/1993 | Lloyd | 283/48.1 |
| 5,628,530 | 5/1997 | Thorton | 283/67 |
| 5,755,462 | 5/1998 | Lupi . | |
| 5,803,499 | 9/1998 | Tung et al. | 283/56 |

*Primary Examiner*—Willmon Fridie, Jr.
*Assistant Examiner*—Alisa Thurston
*Attorney, Agent, or Firm*—Charles J. Prescott

[57] ABSTRACT

A combination preselected medication sample prescription form, sample payment check, and medication sample regulating device includes a support panel having an obverse or front facing surface which defines a first and second portion thereof. An area for receiving written, printed or typed patient identification information is viewably applied over the first portion and a removable medication prescription form is attached over the second portion of the support panel. The second portion includes a preprinted payment check for a sample quantity or as a partial payment for a larger quantity of preselected medication. This combination permits the physician to simultaneously begin the process of distributing a sample quantity of the preselected medication and to write a prescription for any quantity therefor. The preferred embodiment also includes a manufacturers product information sheet removably attached to either the support panel or the prescription form, or between both.

1 Claim, 3 Drawing Sheets

COMBINATION SAMPLE MEDICATION PAYMENT CHECK AND MEDICATION PRESCRIPTION DEVICE

BACKGROUND OF THE INVENTION

1. Scope of Invention

This invention relates generally to sample pharmaceutical prescriptions, and more particularly to a combination preselected prescription form, payment check for the sample prescription and medication sample dispense regulating device.

2. Prior Art

Pharmaceutical manufacturers routinely distribute packaged samples of small quantities of medication for distribution by medical practitioners who are likely to prescribe the medication to their patients. These medications may typically be in the form of capsules, tablets or pills or may be in the form of bottled liquid medications. In my prior U.S. Pat. No. 5,755,462, I have provided such a sampler which also includes the provision for writing a prescription for the preselected medication.

However, this practice of regulating prescription distribution, whether in conjunction with devices such as disclosed in my '462 patent, or distributed in sample containers alone directly by the medical practitioner, facilitate uncontrolled and unrecorded prescribed medication distribution by the medical practitioner. That is to say that there typically may be written documentation, except perhaps for the medical practitioner's internal records, that a particular patient has been provided with sample prescription medication.

Each year, an average of 206,000 people die and over 2 million people have severe side effects from taking drugs without information being furnished by the physician as to the possible side effects for taking the sample drug with other drugs or the possibility that the drug sample given to them may have an adverse side effect on their system. Therefore, it is important to provide product sample information with each and every medication sample and in a prominent position or placement with respect to the sample to enhance the likelihood that it will be read by the patient.

Moreover, there appears to be a large waste aspect with respect to medication samples as many are freely given out by physicians and other medical practitioners both without writing a formal prescription for these medications and the likelihood that the medication will never be consumed by the patient.

The present invention provides a combination medication sample prescription form for a preselected medication, a payment check to a to-be-designated pharmacy for the preselected medication to cover either the cost of a sample quantity or to partially pay for a larger quantity, and implicitly, a medication sample regulating device because of having to fill out the prescription for the preselected medication which is then entered into the records of a licensed pharmaceutical dispenser when filled. The preferred embodiment further includes a product information sheet describing the medication, etc., as provided by its manufacturer.

BRIEF SUMMARY OF THE INVENTION

This invention is directed to a combination preselected medication sample prescription form, sample payment check, and medication sample regulating device includes a support panel having an obverse or front facing surface which defines a first and second portion thereof. An area for receiving written, printed or typed patient identification information is viewably applied over the first portion and a removable medication prescription form is attached over the second portion of the support panel. The second portion includes a preprinted payment check for a sample quantity or as a partial payment for a larger quantity of preselected medication. This combination permits the physician to simultaneously begin the process of distributing a sample quantity of the preselected medication and to write a prescription for any quantity therefor. The preferred embodiment further includes a manufacturer's product information sheet removably positioned between the prescription form and sample check.

It is therefore an object of this invention to provide a combination medication prescription for a preselected pharmaceutical and valid payment check for either the entire sample or as partial payment for a larger quantity of the preselected medication.

It is yet another object of this invention to provide a sample medication prescription device which also includes a valid payment check for the sample medication and a medication sample control device which requires independent regulated verification and record keeping of the preselected medication prescription and patient identification information associated therewith.

It is a further object of this invention to additionally provide a product information sheet which is an integral part of a combination medication prescription form and valid sample check.

In accordance with these and other objects which will become apparent hereinafter, the instant invention will now be described with reference to the accompanying drawings.

DETAILED DESCRIPTION OF THE INVENTION

Figure 1:
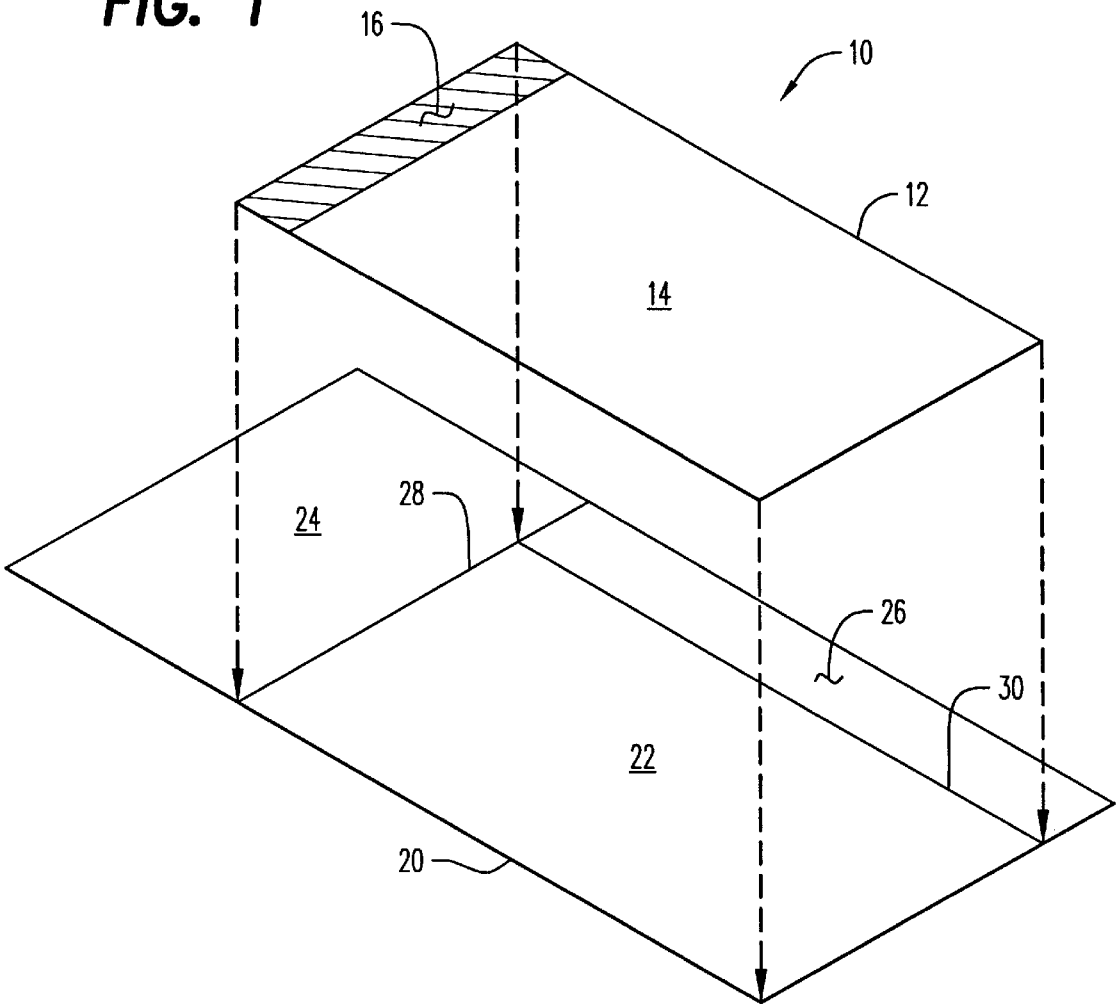
FIG. 1 is an exploded perspective schematic view of the invention absent printed indicia for clarity.
Figure 2:
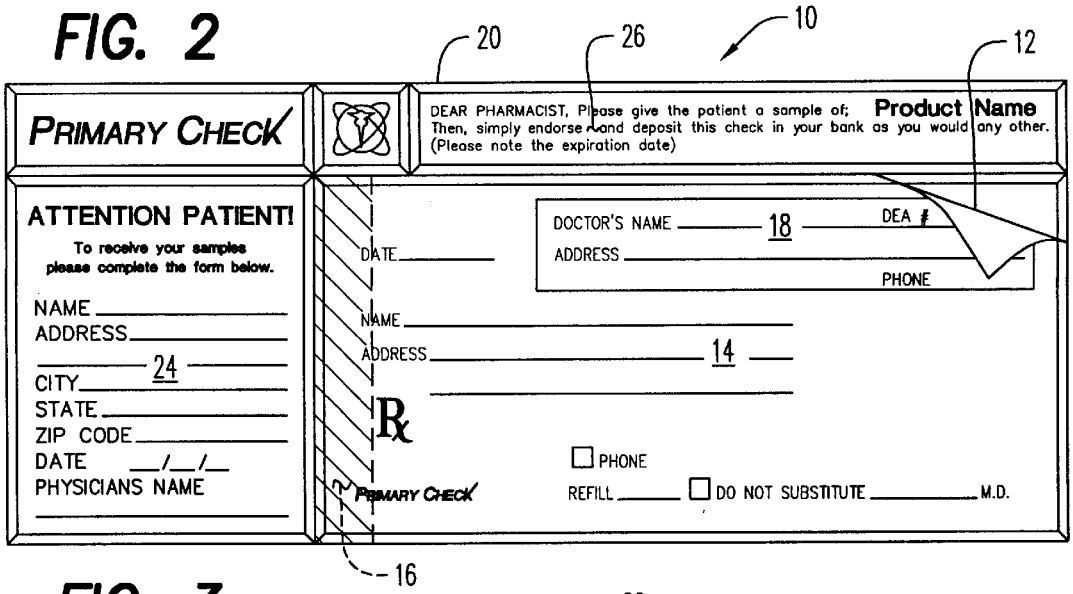
FIG. 2 is a top plan view of the entire invention.

Referring now to the drawings, and particularly to FIGS. 1 to 4, the invention in one embodiment is shown generally at numeral 10 in FIGS. 1 and 2. The device 10 includes a support panel 20 formed of printable sheet paper and the like and a removable prescription form 12 attached over one portion 22 of the support panel 20. Removable attachment of the prescription form 12 is effected by an adhesive applied to area 16.

The prescription form 12 is for a preselected regulated medication and provides a central area 14 onto which the medical practitioner's information and patient information may be entered by writing, typing or printing thereon. It is intended that the prescription form 12 also include the trademark or trade name identification as a promotion of the preselected pharmaceutical to be dispensed by the completed prescription form 12.

Figure 3:
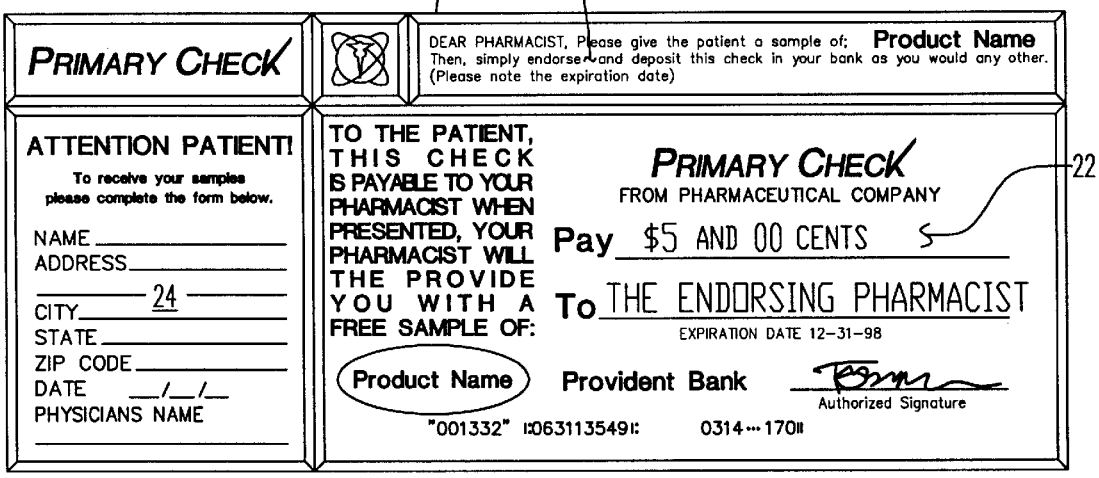
FIG. 3 is a top plan view of the support panel of the invention with the prescription form removed.
Figure 4:
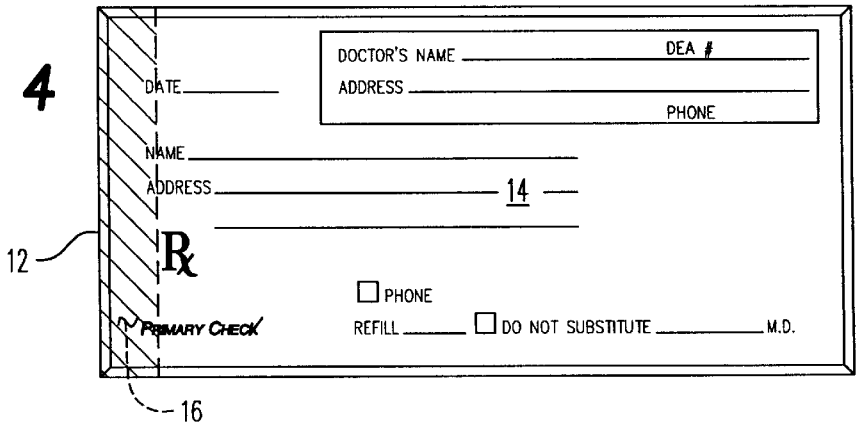
FIG. 4 is a top plan view of the removable prescription form of the preselected sample medication.

The support panel 20 includes another portion or area 24 as best seen in FIGS. 2 and 3 for receiving typed, printed or written information identifying the patient that receives the completed device 10 and, subsequently, the prescribed medication. A second portion 22 of the support panel 20 as best seen in FIG. 3 includes a preprinted payment check drafted in an amount sufficient to cover a sample quantity of the preselected pharmaceutical which is being prescribed. However, it is intended that the check amount also be applied to a larger quantity of the preselected pharmaceutical should the patient and the medical practitioner executing the prescription form 20 so determine. All that would then typically be required by the medical practitioner and the patient receiving the completed device 10 would be to enter the name of the endorsing pharmacist or to allow the pharmacist to simply apply a preprinted stamp thereto in order to remove and negotiate the check 22 after the preselected pharmaceutical supply is dispensed.

A third portion 26 of the support panel 20 positioned above the sample payment check 22 is provided to instruct the pharmacist as to the trade designation of the pharmaceutical or medication to be dispensed. This also provides an area for brief promotional information by the pharmaceutical manufacturer or the preselected medication.

Figure 5:
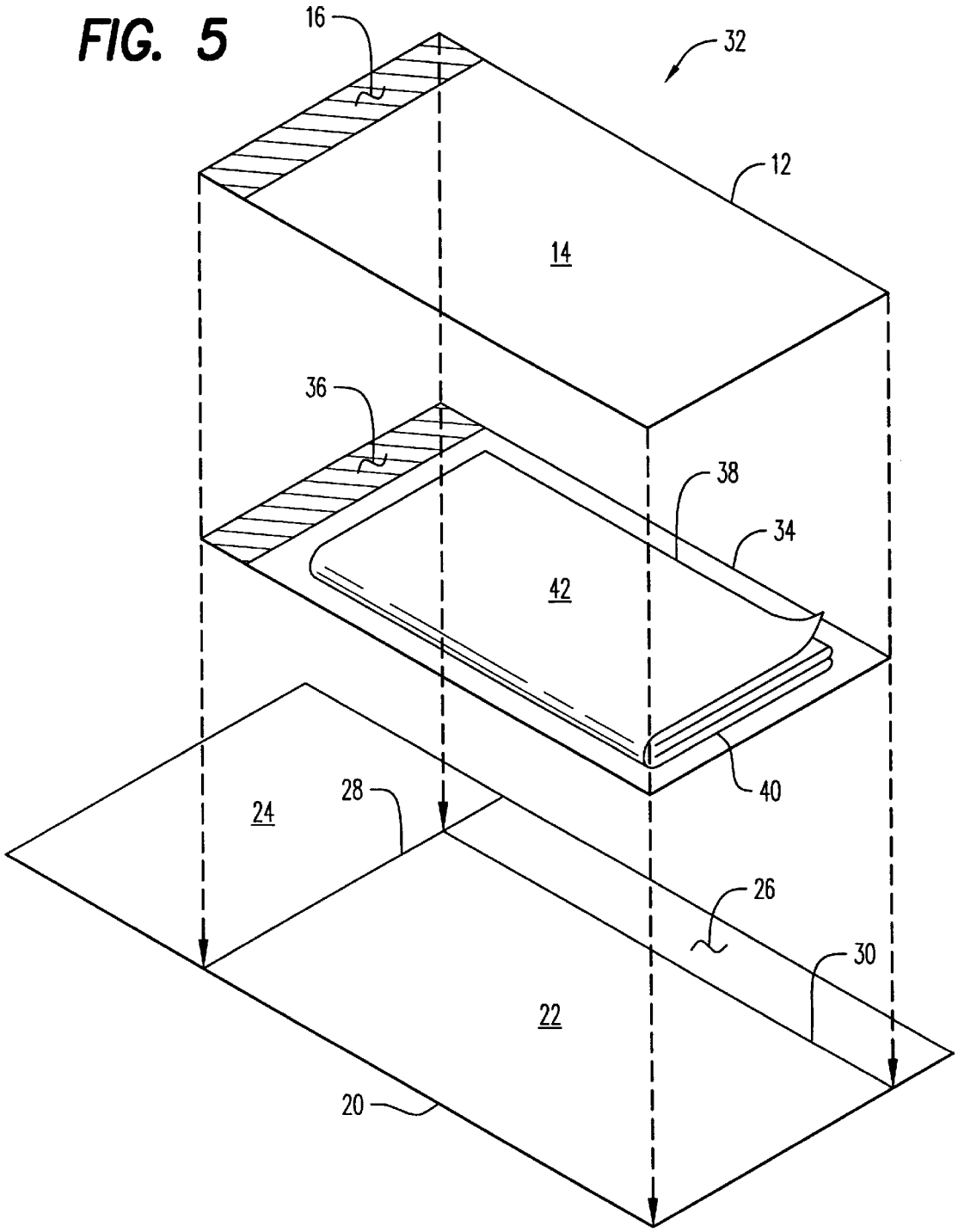
FIG. 5 is an exploded perspective schematic view of the preferred embodiment of the invention absent printed indicia for clarity.

Referring now to FIG. 5, the preferred embodiment of the invention is shown generally at numeral 32 and includes the same support panel 20 formed of printable sheet paper having indicia defining one portion 22 thereof defining a valid pre-printed payment check and another area 24 thereof which defines an area for directly receiving typed, printed or written information identifying the patient that receives the completed device 32.

This embodiment also includes a top sheet or panel 12 bearing printed indicia 14 defining a medication prescription form. A carrier sheet 34 is positioned between the support panel 20 and the medication prescription form 12. This carrier sheet 34 carries a manufacturer's product information sheet 42 having its rear panel 40 attached to the carrier sheet 34. As shown, these product information sheets 42 are typically folded as supplied by the medication manufacturer.

The three components 20, 34 and 12 are attached by releasable adhesion areas 16 and 36 and oriented as indicated by the direction of the phantom arrows in FIG. 5.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A combination medication payment check and medication prescription device comprising:

a support panel having first and second portions of an obverse surface thereof;

said first portion having printed indicia for receiving patient identification information to be written, printed or typed thereon;

a separate removable medication prescription form for a preselected medication held by releasable adhesive to and substantially over said second portion;

said second portion also having printed indicia defining a medication payment check for a sample of the preselected medication, said payment check later made payable to the sample prescription fulfillment pharmacy only for the preselected medication; a manufacturer's product information sheet carrying indicia describing the preselected medication and held by releasable adhesive between said support panel and said medication prescription form.

* * * * *